United States Patent [19]

Lewis

[11] 4,354,856

[45] Oct. 19, 1982

[54] METHOD AND APPARATUS FOR RECOVERING MAGNETIC PARTICLES

[75] Inventor: Robert T. Lewis, Albany, Calif.

[73] Assignee: Chevron Research Company, San Francisco, Calif.

[21] Appl. No.: 228,654

[22] Filed: Jan. 26, 1981

[51] Int. Cl.[3] ..... B03C 1/00

[52] U.S. Cl. ..... 55/3; 55/100; 209/214; 209/8; 209/228; 209/232

[58] Field of Search ..... 209/214, 215, 223 R, 209/232, 39, 228, 229, 8; 210/695, 222, 223; 335/305; 134/17, 19; 55/100, 3; 501/145, 150

[56] References Cited

U.S. PATENT DOCUMENTS

| | | | |
|---|---|---|---|
| 987,156 | 3/1911 | Mc Larty | 209/8 |
| 1,286,247 | 12/1918 | Davis | 209/8 |
| 2,678,130 | 5/1954 | Onstad | 209/8 |
| 2,807,363 | 9/1957 | Hendrickson | 209/8 |
| 3,507,026 | 9/1968 | Koln | 210/222 |
| 3,838,773 | 10/1974 | Koln | 209/223 R X |
| 3,873,448 | 3/1975 | Isberg | 209/232 X |
| 4,100,491 | 7/1978 | Newman | 335/305 X |
| 4,116,829 | 9/1978 | Clark | 209/214 X |
| 4,119,500 | 10/1978 | Ishizuka | 361/267 |

FOREIGN PATENT DOCUMENTS

| | | | |
|---|---|---|---|
| 54-47901 | 1/1979 | Japan | 55/100 |
| 17461 | of 1900 | United Kingdom | 55/100 |
| 467755 | 6/1972 | U.S.S.R. | 55/100 |
| 532394 | 12/1976 | U.S.S.R. | 209/228 |

OTHER PUBLICATIONS

Geo. Phys. J. R. Astr. Soc. (1970) 21 (531-534), Heller et al.

Iammartino, N. R., "New Tasks for Magnetism", *Chemical Engineering*, Jan. 7, 1974.

Watson, J. H. P. et al, "A Superconducting Magnetic Separator and its Application in Improving Ceramic Raw Materials", 11th Intl. *Mineral Processing Congress* (1975).

*Primary Examiner*—Ralph J. Hill

*Attorney, Agent, or Firm*—D. A. Newell; S. R. La Paglia; A. H. Uzzell

[57] ABSTRACT

A method and apparatus for recovering magnetic particles from a fluid stream is provided. The fluid is contacted with a ferromagnetic element to cause attraction and collection of the particles. The ferromagnetic element is then heated to a temperature near or above the Curie temperature of at least one of (1) the ferromagnetic element and (2) collected magnetic particles. The collected magnetic particles are then disengaged from the ferromagnetic element. Preferably the ferromagnetic element is disposed in an applied magnetic field and the heating is preferred by passing alternating electric current through the element thereby causing sufficient vibration to disengage the particles.

18 Claims, 1 Drawing Figure

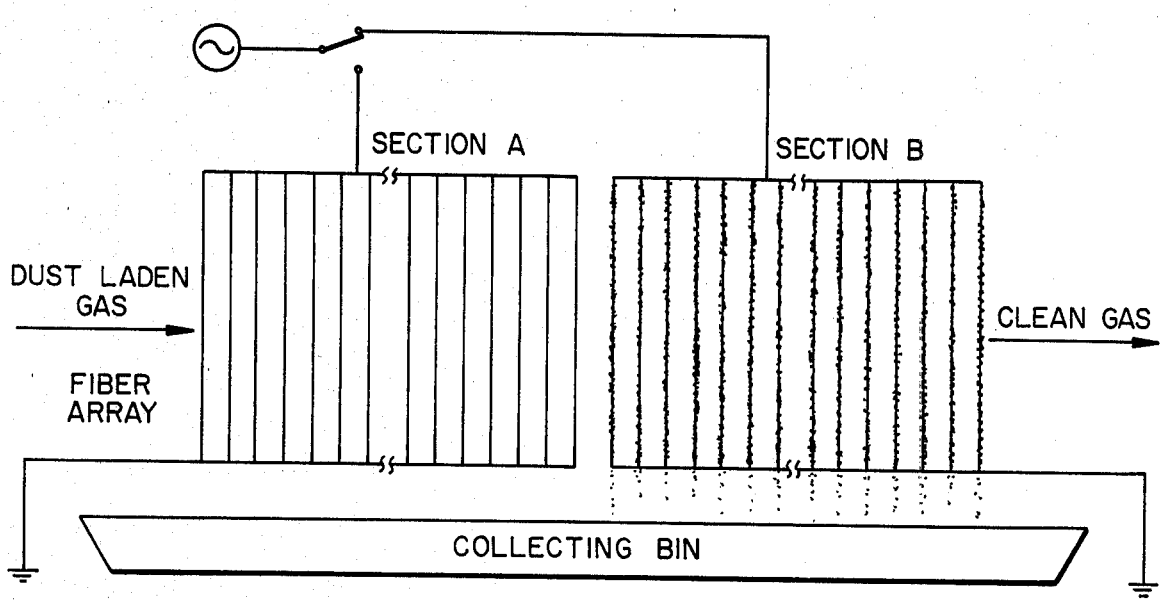
SECTION A
SECTION B
DUST LADEN GAS
FIBER ARRAY
CLEAN GAS
COLLECTING BIN

METHOD AND APPARATUS FOR RECOVERING MAGNETIC PARTICLES

BACKGROUND OF THE INVENTION

This invention relates to the separation of suspended particles from a fluid by the application of a magnetic field. The invention involves the magnetic separation of ferromagnetic and paramagnetic particles from fluids by exposing a suspension of particles in a fluid to a magnetic field to cause the migration of particles under the influence of the field (due to the field gradient) thereby permitting recovery of a fluid product having a reduced solids concentration. Of recent interest is the technique known as high-gradient magnetic separation (HGMS). HGMS involves the interaction between a filtration element comprised of a ferromagnetic material such as wire elements and small ferromagnetic or paramagnetic particles in an applied magnetic field, i.e., a magnetic field provided by a source external to the ferromagnetic element. Magnetic field gradients around the elements are several orders of magnitude higher than in the absence of the ferromagnetic filtration element. The fluid feed stream containing suspended particles is passed in the vicinity of the ferromagnetic element. Those magnetic particles which pass within the capturing distance that the element presents to the fluid stream are caused to migrate to the element and are removed from the stream. In commercial practice the ferromagnetic element is in the form of a steel mesh and the external magnetic field is generally applied by an electromagnet. Superconducting electromagnets and permanent magnets have also been proposed for this application. An example of an HGMS system suitable for use according to this invention is described in the article "New Tasks For Magnetism", Chemical Engineering, January 7, 1974, pp. 50–52 which is incorporated herein by reference.

The applicability of magnetic separation techniques for removal of solids is dependent on a number of complex phenomena. For example, when magnetic separation is applied to a flowing fluid, the magnetic force must overcome fluid drag and in some cases gravitational forces, which are related to the size and density of the particles relative to the amount of magnetic material present. The recovery of magnetic particles from a stationary magnetic separator typically involves turning off the magnetic field and backflushing the filter media.

SUMMARY OF THE INVENTION

It is an object of this invention to provide a method and apparatus for recovering magnetic particles from a fluid stream which takes advantages of the thermal dependence of magnetization. It is a further object to provide a method and apparatus which facilitates the removal of collected magnetic particles. These and other objects are achieved in a method for recovering magnetic particles from a fluid stream comprising, (a) contacting said stream with a ferromagnetic element to attract and collect magnetic particles from the fluid stream; (b) heating said ferromagnetic element to a temperature near or above the Curie temperature of at least one of (1) the ferromagnetic element and (2) collected magnetic particles; and (c) disengaging collected particles from the heated ferromagnetic element. In its apparatus aspect this invention comprises an apparatus for recovering magnetic particles from a fluid stream comprising (a) a ferromagnetic element disposed within a pathway for said fluid stream for attracting and collecting magnetic particles from said fluid stream; (b) means for heating the ferromagnetic element to a temperature near or above the Curie temperature of at least one of (1) the ferromagnetic element and (2) collected magnetic particles and; (c) means for releasing collected particles from said heated ferromagnetic element.

BRIEF DESCRIPTION OF THE DRAWING

The single FIGURE of drawing is a schematic representation of the apparatus of this invention.

DETAILED DESCRIPTION

An aspect of this invention is the application of the temperature dependence of ferromagnetic phenomena to the art of magnetic separation of particles. Generally when a ferromagnetic material is heated, its magnetization declines continuously until it reaches a very small value. Some materials upon heating undergo transformations to different chemical or physical structures which can have an increased magnetization. Even these new structures, however, will lose all ferromagnetic properties upon heating to sufficient temperature. The temperatures at which the ferromagnetism of a material disappears so that it becomes only paramagnetic is the material's Curie temperature. Curie temperatures for substances can be determined by simply measuring the magnetism of the substance at increasingly high temperatures and observing the temperature at which the magnetic force becomes greatly reduced.

The method and apparatus of this invention are useful for virtually any magnetic separation application. Examples of such applications are described in the Kirk-Othmer Encyclopedia of Chemical Technology, Second Edition, Vol. 12, pages 782–800, John Wiley and Sons, New York, 1967, which is incorporated herein by reference.

According to this invention a fluid stream containing magnetic particles is contacted with a ferromagnetic element to cause the attraction and collection of magnetic particles. The ferromagnetic element can be any ferromagnetic metal or alloy, and the contacting can occur at any temperature at which the element and the particles are ferromagnetic. The element is then heated to a temperature near or above the Curie temperature of either the ferromagnetic element or at least a portion of the collected magnetic particles (or both) and the collected particles are then disengaged from the ferromagnetic material. When the heating is to a temperature below the Curie temperature, it must be sufficiently near the Curie temperature to reduce the magnetization sufficiently to permit the particles to be disengaged from the element. The disengaging of collected particles can be accomplished in a separate step or simultaneously with the heating of the element. Disengaging of the collected particles can be performed, for example, by the forces of gravity, by flushing the element with a fluid such as an inert gas, or by vibration of the element concurrently with heating.

Because of the high collection efficiencies obtainable, it is preferred that the ferromagnetic element be disposed with an applied magnetic field, as is practiced in high gradient magnetic separators. The collected particles can be heated by any suitable means, for example, by contacting the element with a hot fluid or by conduction or radiation heat transfer. Heating may also be achieved by induction heating employing a radio frequency field. Electrical resistance heating may also be used, for example, by passing an electric current through the ferromagnetic element.

A particularly advantageous method of heating is to pass an alternating electric current through the ferromagnetic element while disposed within an applied magnetic field. When an alternating current is passed through a ferromagnetic material in an applied magnetic field, a vibration occurs in the material. By appropriate selection of current, frequency, and magnetic field strength, sufficient vibration can be achieved in the ferromagnetic element to dislodge or disengage the collected particles. Alternately, or concurrently, mechanical vibration of the heated ferromagnetic element can be employed.

The apparatus of this invention is preferably composed of a plurality of ferromagnetic elements disposed such that while one segment of elements is being heated to disengage collected particles, one or more segments of elements remains magnetic and continues to collect particles. A particular advantage of this invention is that particles can be recovered without turning off the magnetic field.

The ferromagnetic element can be composed of any ferromagnetic material, and preferably has a large surface area. Suitable configurations include fibers, meshes, and sheets or plates having pointed or studded surfaces. When fibers or meshes are employed, it is preferred that the fiber or wire diameter be approximately three times the average size of the particles to be collected, in order to maximize the collection efficiency.

The FIGURE is a schematic diagram of an apparatus for practicing the invention. Dust laden gas enters an array of parallel stainless steel fibers extending perpendicularly to the direction of flow. A magnetic field is applied in the direction of gas flow by an electromagnet (not shown). An alternating current source is passed alternately through sections A and B of the fiber array. The current causes the heating of the fibers above the Curie temperature of the fibers or the collected particles (or both), while simultaneously causing the fibers to vibrate, thereby releasing collected particles. The unheated section of fibers continues to remove magnetic particles from the dust laden gas.

SPECIFIC EMBODIMENT

The apparatus and method of this invention are particularly useful for separating particles of oil shale minerals from retorted oil shale and other fluid streams. An example of such an oil shale retorting process is described in U.S. Pat. No. 4,199,432 for "Staged Turbulent Bed Retorting Process", issued to Tamm et al, April 22, 1980, which is incorporated herein in its entirety by reference. In this retorting process raw shale particles are mixed with hot previously retorted and combusted shale particles, introduced into a vertically elongated retort, and passed downwardly therethrough. A stripping gas substantially free of molecular oxygen, such as steam, is introduced to a lower portion of the retort and passed upwardly through the retort, fluidizing a portion of the shale particles. Hydrocarbonaceous materials in the gaseous phase (shale oil retorted from the raw shale particles), stripping gas and entrained fines are withdrawn from the upper portion of the retort. This fluid stream is passed through one or more stages of cyclone separators or electrostatic precipitators to remove the bulk of the large particles. The solids-lean effluent from these preliminary separation stages is then passed to the magnetic separation stage of this invention. The size of particles in the feed to the magnetic separation stage is very fine; at least 90% of the particles by weight are smaller than 10 micrometers, and typically smaller than 4 micrometers in diameter (equivalent sphere diameter). The stream is passed through the apparatus of this invention comprising as a magnetic element, a stainless steel wire mesh with filaments extending perpendicularly to the direction of the fluid flow. A magnetic field with an average field strength of about 5 to 20 kOe, preferably 10 kOe, is applied in the direction of the fluid flow with an electromagnet. The stainless steel filaments are joined at the ends into a current collector which is connected to a source of alternating electric current. An additional section of stainless steel mesh is disposed downstream within the magnetic field and connected to the electric current source in a similar manner, such that the alternating current passes to only one section of mesh at a time. In the initial stages of operation most of the particles are collected on the upstream section. After the upstream section has reached its capacity, a particle recovery cycle is begun by passing an alternating current of 60 Hz and sufficient amperage through the upstream section causing the temperature of the fibers to reach at least about 560° C. and preferably at least about 590° C., which is near or above the Curie temperature of substantially all the magnetic oil shale mineral solids. The current will cause sufficient heating and vibration of the particles in the first array to cause the disengaging of the collected particles. In some applications a frequency higher than 60 Hz may be required to achieve sufficient vibration. The disengaged particles are recovered in a hopper and conducted to a suitable storage site. After the upstream section has been freed of substantially all the magnetic particles, the current is turned off and the fibers are allowed to cool to below about 510° C. Cooling can be enhanced by flowing gas if desired. Alternating current is then passed to the downstream section of mesh and the cycle is repeated. If excessive re-entrainment of collected particles occurs during the recovery cycle or if the heated filaments cause excessive coking of the carbonaceous vapors, the retorted shale oil feedstream can be diverted during the recovery cycle, for example, to a parallel high gradient magnetic separator.

In the staged turbulent bed retorting process retorted shale particles are conducted to a combustor wherein they are contacted with an oxygen-containing gas to burn off carbonaceous residues. The bulk of spent shale (i.e., combusted) shale is recovered from the combustor flue gas by cyclone separators. A portion of the spent shale is recycled to the retort to provide heat to the process. The flue gas from the combustor and cyclone separator contains finely divided oil shale mineral particles which are also amenable to separtion by the method and apparatus of this invention, under essentially the same conditions as described above for the retort effluent. Because the combustor effluent gas does not contain substantial quantities of hydrocarbons, coking during the magnetic fiber heating cycle does not present a problem.

It will be appreciated that the method and apparatus of this invention can be practiced in a wide variety of embodiments other than those specifically illustrated herein. Such embodiments which employ the thermomagnetic effects illustrated herein are contemplated as equivalents of the invention disclosed herein.

What is claimed is:

1. A method for recovering magnetic paticles from a fluid comprising (a) contacting said fluid with a ferromagnetic element to cause the attraction and collection of magnetic particles from said fluid;

(b) heating said ferromagnetic element to a temperature near or above the Curie temperature of at least one of (1) the ferromagnetic element and (2) collected magnetic particles; and (c) disengaging collected magnetic particles from said ferromagnetic element.

2. The method of claim 1 wherein said ferromagnetic element is heated by passing electric current through said ferromagnetic element.

3. The method of claim 1 wherein said collected particles are disengaged by vibrating said ferromagnetic element.

4. The method of claim 1 wherein said ferromagnetic element is disposed within an applied magnetic field.

5. The method of claim 1 wherein said ferromagnetic element is disposed within an applied magnetic field and said ferromagnetic element is heated by passing alternating electric current through said ferromagnetic element to cause sufficient vibration of said ferromagnetic element to release collected particles from said ferromagnetic element.

6. The method of claim 1 wherein said fluid comprises retorted shale oil containing oil shale mineral solids.

7. The method of claim 1 wherein said fluid stream comprises flue gas from an oil shale combustor said flue gas containing oil shale mineral solids.

8. An apparatus for recovering magnetic particles from a fluid stream comprising (a) a ferromagnetic element disposed within a pathway for said fluid stream for attracting and collecting magnetic particles from said fluid stream (b) means for heating said ferromagnetic element to a temperature near or above the Curie temperature of at least one of (1) the ferromagnetic element and (2) collected magnetic particles (c) means for releasing collected particles from said heated ferromagnetic element.

9. The apparatus of claim 8 wherein said means for heating the ferromagnetic element is a means for passing electric current through said ferromagnetic element.

10. The apparatus of claim 8 wherein said means for releasing collected particles is a means for vibrating said ferromagnetic element.

11. The apparatus of claim 8 wherein said ferromagnetic element is disposed within an applied magnetic field.

12. The apparatus of claim 8 wherein said ferromagnetic element is disposed within an applied magnetic field and said means for heating the ferromagnetic element is a means for passing alternating electric current through said ferromagnetic element to cause sufficient vibration of said ferromagnetic element to release collected particles from said ferromagnetic element.

13. A method for recovering magnetic particles from a gaseous fluid comprising (a) contacting said gaseous fluid with a ferromagnetic element to cause the attraction and collection of magnetic particles from said gaseous fluid;

(b) heating said ferromagnetic element to a temperature near or above the Curie temperature of at least one of (1) the ferromagnetic element and (2) collected magnetic particles; and (c) disengaging collected magnetic particles from said ferromagnetic element.

14. The method of claim 13 wherein said ferromagnetic element is heated by passing electric current through said ferromagnetic element.

15. The method of claim 13 wherein said collected particles are disengaged by vibrating said ferromagnetic element.

16. The method of claim 13 wherein said ferromagnetic element is disposed within an applied magnetic field.

17. The method of claim 13 wherein said ferromagnetic element is disposed within an applied magnetic field and said ferromagnetic element is heated by passing alternating electric current through said ferromagnetic element to cause sufficient vibration of said ferromagnetic element to release collected particles from said ferromagnetic element.

18. The method of claim 13 wherein said gaseous fluid stream comprises retorted shale oil containing oil shale mineral solids.

* * * * *